US005883503A

United States Patent [19]

Lace

[11] Patent Number: 5,883,503

[45] **Date of Patent: *Mar. 16, 1999**

[54] VOLTAGE COMPENSATION SYSTEM

[75] Inventor: Melvin A. Lace, 3 Garden Ct., Prospect Heights, Ill. 60070

[73] Assignees: Melvin A. Lace, Des Plaines; Thomas E. Dorn, Clarendon Hills, both of Ill.; a part interest

[ * ] Notice: The term of this patent shall not extend beyond the expiration date of Pat. No. 5,712,552.

[21] Appl. No.: 869,838

[22] Filed: Jun. 5, 1997

Related U.S. Application Data

[63] Continuation-in-part of Ser. No. 662,126, Jun. 12, 1996, Pat. No. 5,712,554, which is a continuation-in-part of Ser. No. 568,249, Dec. 22, 1995, abandoned.

[51] Int. Cl.[6] ..... G05F 1/24

[52] U.S. Cl. ..... 323/259; 323/245; 336/147

[58] Field of Search ..... 323/245, 247, 323/255, 259, 340, 359; 363/21, 59, 74; 336/107, 147

[56] References Cited

U.S. PATENT DOCUMENTS

| | | | |
|---|---|---|---|
| 1,818,589 | 8/1931 | Thornton et al. . | |
| 2,036,305 | 4/1936 | Snyder . | |
| 2,063,693 | 12/1936 | McCarthy | 323/259 |
| 2,090,671 | 8/1937 | Gay . | |
| 2,282,838 | 5/1942 | Whitmore | 323/259 |
| 2,292,829 | 8/1942 | Garin . | |
| 2,349,682 | 5/1944 | Snyder . | |
| 3,199,020 | 8/1965 | Hilker | 323/259 |
| 3,230,414 | 1/1966 | Karger . | |
| 3,243,749 | 3/1966 | Zlachevsky . | |
| 3,452,311 | 6/1969 | Beck et al. . | |
| 3,611,228 | 10/1971 | Walling | 336/147 |
| 3,621,374 | 11/1971 | Kettler | 323/343 |
| 4,500,829 | 2/1985 | Specht et al. . | |
| 4,694,241 | 9/1987 | Genuit | 323/340 |
| 4,745,352 | 5/1988 | McGuire . | |
| 4,791,348 | 12/1988 | McGuire et al. . | |
| 4,837,497 | 6/1989 | Leibovich . | |
| 5,018,058 | 5/1991 | Ionescu et al. . | |
| 5,311,419 | 5/1994 | Shires . | |
| 5,355,295 | 10/1994 | Brennen | 363/40 |
| 5,545,971 | 8/1996 | Gomez et al. | 323/259 |

*Primary Examiner*—Stuart N. Hecker
*Attorney, Agent, or Firm*—Dorn, McEachran, Jambor & Keating

[57] ABSTRACT

A voltage compensation system for an A.C. power line supplying one or more air conditioners, a telephone system or other telecommunication system, a battery charger, or some other utilization system that should have an input voltage within a given normal range. The voltage compensation system includes a transformer unit containing a transformer having at least two windings coupled electromagnetically by a transformer core; one of those windings preferably is in two segments that are connectable in series or in parallel. One winding is connected to an input terminal and to an output terminal. The other winding adds to the A.C. line voltage when the line voltage drops below a low voltage threshold and/or subtracts from the line voltage when the A.C. line voltage exceeds a high voltage threshold. If the A.C. line voltage is in the range required by the utilization system, the other transformer winding is effectively shorted out or otherwise disconnected. In automated versions, a line voltage sensor actuates a switching circuit to effect the desired compensation action. The voltage compensation system may handle under-voltage conditions, over-voltage conditions, or both. For chronic under-voltage or over-voltage conditions, direct winding connections may be employed instead of relays.

10 Claims, 9 Drawing Sheets

($V_{IN}$ NORMAL)

($V_{IN}$ LOW)

($V_{IN}$ VERY LOW)

($V_{IN}$ HIGH)

($V_{IN}$ VERY HIGH)

($V_{IN}$ HIGH)

($V_{IN}$ VERY HIGH)

($V_{IN}$ LOW)

($V_{IN}$ VERY LOW)

VOUT
L3
L4
VR1
80
86
83
84
82
RL11
RL12
RL13
401
402
403
404
406
407
408
409
369
370
384
383
368
423
445
440
441
442
443
444
513
TO REF
REF. GRND.
422
420
300
315
314
312
328B
329B
339
R11
342
340
336
341
343
352
354
350
316B
316A
353
R13
351
355
330
332
335
334
331
R12
333
328A
329A
416
419
321
417
418
414
412
410
L1
VIN
L2
349
348
325
361
362
366
391
381
382
323
364
10K
300K
REF 513
346B
346A
345A
347
344
345B ($V_{IN}$ LOW)

($V_{IN}$ HIGH)

($V_{IN}$ VERY HIGH)

($V_{IN}$ VERY LOW)

VOLTAGE COMPENSATION SYSTEM

This patent application is a continuation-in-part of an allowed prior patent application Ser. No. 08/662,126 filed Jun. 12, 1996, issued Jan. 27, 1998 as U.S. Pat. No. 5,712,554. That prior application was a continuation-in-part of another prior patent application Ser. No. 08/568,249 filed Dec. 22, 1995 and now abandoned.

BACKGROUND OF THE INVENTION

There are numerous different electrically-energized utilization systems that should have an A.C. input within a given normal voltage range. One example is an A.C. energized air conditioner; if the A.C. line energizing the air conditioner falls below a given threshold voltage level, whether permanently or for a substantial period of time, the air conditioner may overheat and may suffer permanent damage. Another example is a telephone or other telecommunication system or a battery charger that relies upon an A.C. input voltage in a given normal range. When the input voltage exceeds the upper limit of that range for any substantial period of time, the system may be severely damaged or even virtually destroyed. Other utilization systems may react adversely to inputs either above or below their normal input voltage range.

Compensation circuits have been proposed for both over-voltage and under-voltage A.C. power line conditions. For the most part, known voltage compensation devices have been relatively large and expensive. Indeed, the cost of an effective voltage compensation device may be comparable to the cost of the utilization apparatus that it protects.

SUMMARY OF THE INVENTION

It is a principal object of the invention to provide a new and improved voltage compensation system that maintains the A.C. voltage applied to a utilization device within a given normal range despite substantial variation of an A.C. energization line above or below that range.

Another object of the invention is to provide a new and improved circuit for a voltage compensation device that employs switching of just one two-segment transformer winding to compensate for both under-voltage and over-voltage conditions for an A.C. line connected to a utilization system which functions best within a given input voltage range.

A further object of the invention is to provide a new and improved voltage compensation device that is small, simple, durable and inexpensive, and that is suitable for either temporary or semi-permanent A.C. line voltage variations.

Accordingly, in one aspect the invention relates to a voltage compensation system for connecting an A.C. line to a utilization system having a normal voltage input range. The voltage compensation system comprises: a transformer unit including a first transformer winding having opposite ends, a second transformer winding having opposite ends, a transformer core electromagnetically coupling the first and second transformer windings, a first input terminal adapted to be connected to an A.C. line and connected to one end of the first transformer winding, a second input terminal adapted to be connected to an A.C. line, a first output terminal connected to the other end of the first transformer winding, a second output terminal connected to the second input terminal, and a transformer unit connector having a plurality of connection terminals, one connection terminal connected to each of the opposite ends of each of the transformer windings and one connection terminal connected to the second input terminal. The system further comprises a second connector, mating with the transformer unit connector and having a number of control terminals, each control terminal being connected to one connection terminal. Switching means are connected to the control terminals of the second connector for changing the connections of the transformer windings.

In another aspect, the invention relates to a transformer unit for a voltage compensation system for connecting an A.C. power line to a utilization system having a predetermined normal voltage input range, the A.C. line being subject to voltage variations above or below the normal range for the utilization system the transformer unit comprises at least two transformer windings, each having opposite ends, and a transformer core electromagnetically coupling the transformer windings to each other. There is also a connector having a plurality of connection terminals, each accessible externally of the transformer unit; the connection terminals are connected to the opposite ends of each of the transformer windings.

DESCRIPTION OF THE PREFERRED EMBODIMENTS

Figure 1:
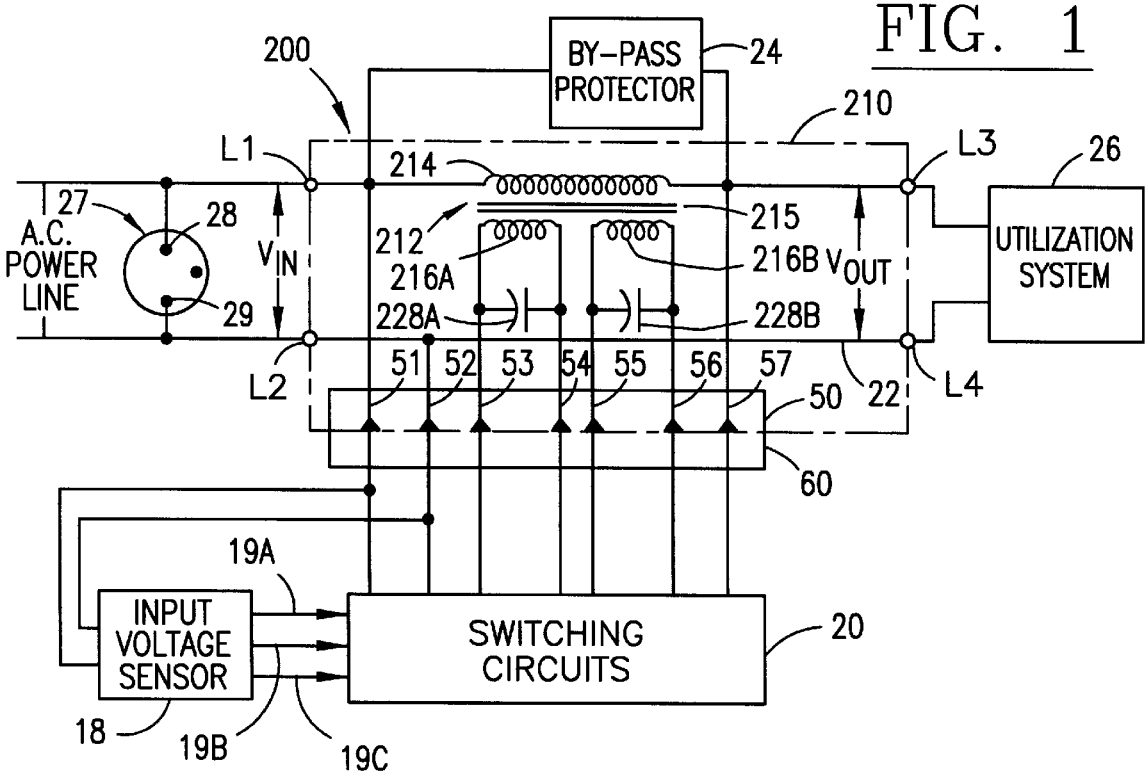
FIG. 1 is a block diagram, partly schematic, of one embodiment of the invention.

FIG. 1 is a block diagram, partly schematic, of a voltage compensation system 200 that includes a voltage compensation transformer unit 210 constructed in accordance with one embodiment of the invention. The conductors of an A.C. power line at the left-hand side of FIG. 1, which line may be subject to appreciable voltage variations either above or below a preselected nominal voltage range, are connected to two input terminals L1 and L2 for transformer unit 210. Transformer unit 210 includes a main transformer 212 having a secondary winding 214 electromagnetically coupled by a core 215 to a primary winding; the primary winding is split into two winding segments or sections 216A and 216B. The primary:secondary voltage ratio of transformer 212 should be greater than 2:1 and preferably exceeds 5:1. The secondary winding 214 of transformer 212 is connected in series between input terminal L1 and an output terminal L3 of transformer unit 210. Unit 210 also includes another output terminal L4 connected to input terminal L2 by a conductor 22.

Voltage compensation system 200 (FIG. 1) further includes a voltage sensor circuit 18 for sensing the input voltage $V_{IN}$ between the input terminals L1 and L2; $V_{IN}$ is the same as the A.C. voltage on the power line to which compensation system 200 is connected. The output of sensor circuit 18 includes at least one actuating signal; in system 200; as illustrated, there are three actuating signals applied to a switching circuit unit 20 via three individual conductors 19A, 19B and 19C. Switching circuit unit 20 is also connected, through a connector plug 60 that mates with a connector plug 50 in transformer unit 210, to the opposite ends of the primary winding segments 216A (conductors 53 and 54) and 216B (conductors 55 and 56) of transformer 212 and to the conductive line 22 (plug conductor 52). The switching circuit unit 20 is also connected, again through plugs 60 and 50, to the opposite ends of the secondary winding 214 of transformer 212 (conductors 51 and 57). Two capacitors 228A and 228B may be connected across primary winding sections 216A and 216B, respectively, if desired.

A bypass protector circuit 24 is shown in FIG. 1, connected in parallel with the secondary winding 214 of transformer 212. An air conditioner, a communication device or system, a computer, a computer system, a battery charger, or some other utilization system 26 is connected to and energized from the output terminals L3 and L4 of compensation system 200. A "crowbar" device 27 may be associated with system 200 for transient surge protection of the transformer 212 in unit 210. In FIG. 1 device 27 is shown as a gas discharge tube having one electrode 28 connected to terminal L1 and another electrode 29 connected to terminal L2. Other surge protection devices may be employed.

Figure 2A:
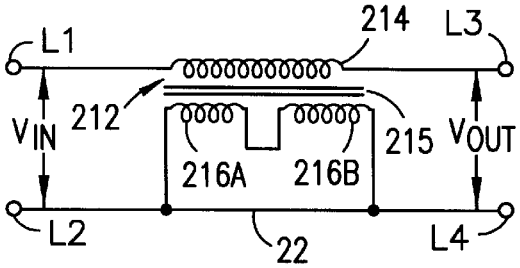
FIGS. 2A, 2B, 2C, 2D and 2E are simplified circuit drawings showing the connections for the transformer of FIG. 1 for normal, low, very low, high and very high input voltage ($V_{IN}$) conditions, respectively.

Operation of system 200, FIG. 1, can now be considered. System 200 affords compensation for two levels of undervoltage and two levels of excessive voltage. When the A.C. input voltage $V_{IN}$ is within the normal line voltage range for the air conditioner, communication apparatus, computer, battery charger, or other utilization system 26, the transformer primary winding, comprising segments 216A and 216B, is effectively short-circuited or otherwise inactivated by switching circuit 20. The connections for the windings of transformer 212 are as shown in FIG. 2A. That is, the primary windings 216A and 216B contribute nothing to the $V_{OUT}$ output voltage across terminals L3 and L4, which is the energizing voltage supplied to utilization system 26, FIG. 1. Further, because the impedance of secondary winding 214 is quite low, the secondary winding exhibits minimal losses. Accordingly, utilization system 26 is energized by an A.C. input, $V_{OUT}$, that is within its normal, desired operating range. Losses in compensation system 200 are minimal, and do not adversely affect the operation of system 26.

Figure 2B:
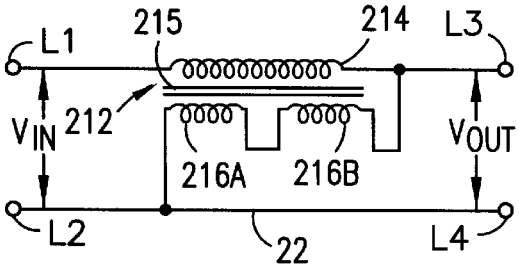

For low-voltage compensation, when the input voltage $V_{IN}$ for compensation system 200 falls below a first threshold value, the reduction in input voltage causes sensor 18 to generate one or more actuating signals, on lines 19A–19C, to actuate switching circuits 20 to change the connections for the primary winding segments 216A and 216B of transformer 212. Winding segments 216A and 216B are connected in series from input terminal L2 to output terminal L3 in an orientation that adds the voltages from transformer primary windings 216A and 216B to the voltage across the secondary winding 214 to develop the output voltage $V_{OUT}$ supplied to utilization device 26. This is the configuration illustrated in FIG. 2B. Transformer 212, in this configuration, preferably has a secondary voltage of ten to twenty-five percent of the normal line voltage; accordingly, the added output voltage can be effective to maintain the output voltage $V_{OUT}$ applied to system 26 within the desired normal range for that utilization system.

Figure 2C:
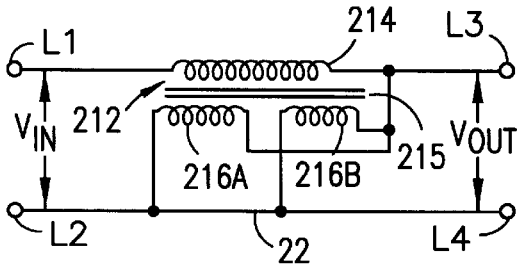

When the input voltage $V_{IN}$ for compensation system 200 falls below a second, lower threshold value, that reduction in input voltage causes sensor 18 to generate one or more actuating signals on the lines 19A–C to switching circuits 20. These actuating signals, different from those produced by sensor 18 for a lesser reduction in the input voltage $V_{IN}$ described immediately above, cause the switching circuits 20 to change the connections for transformer secondary windings 216A and 216B to the configuration shown in FIG. 2C, with windings 216A and 216B in parallel with each other across terminals L2 and L3. Again, transformer 212 functions to maintain the output voltage $V_{OUT}$ to system 26 within its desired normal range.

Figure 2D:
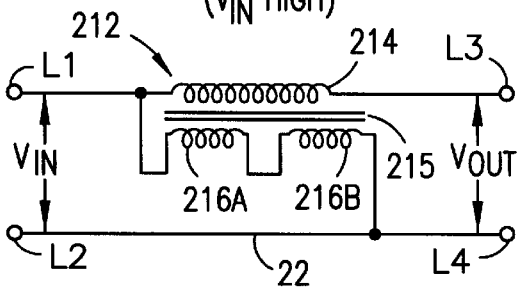

When the input voltage $V_{IN}$ to compensation system 200 exceeds an initial threshold above the normal range for utilization system 26, the high input voltage $V_{IN}$ causes sensor 18 to actuate switching circuit 20, via lines 19A–19C, to connect the transformer primary windings 216A and 216B of transformer 212 in a different configuration, that shown in FIG. 2D. In this instance, however, the electromagnetic orientation of the primary winding sections is reversed as compared with low-voltage compensation. Thus, in high-voltage compensation the secondary output from transformer 212 is in bucking relation to the primary and subtracts from the incoming line voltage $V_{IN}$. Consequently, the output A.C. voltage $V_{OUT}$ is reduced, and can be held to a level within the acceptable input voltage range for system 26.

Figure 2E:
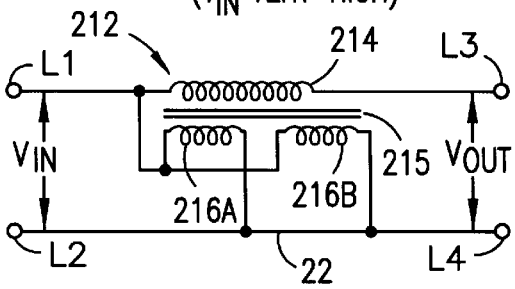

Yet another circuit configuration, for system 200 of FIG. 1 and its transformer 212, is shown in FIG. 2E. This is the configuration achieved when sensor 18 detects a very high voltage condition for the input voltage $V_{IN}$, a condition exceeding a second threshold greater than that referred to immediately above in regard to FIG. 2D. In the FIG. 2E configuration the transformer winding segments 216A and 216B are again reconnected, this time in parallel with each other between terminals L1 and L2. L2 and L4, electrically, are virtually indistinguishable, due to their conductive connection 22.

Low-voltage and high-voltage compensation, using system 200, are not mutually exclusive. The system can be constructed to provide both, as in the specific circuits described and as illustrated and described in FIG. 1 and hereinafter in regard to FIG. 5.

Some exemplary voltage values for $V_{IN}$ and $V_{OUT}$ are worth noting. For an A.C. line voltage that is nominally one hundred seventeen volts, a first low voltage threshold may be established at one hundred volts and a second, lower low voltage threshold may be about ninety volts. An initial high voltage threshold for the same line may be established at one hundred thirty-four volts, assuming that utilization device 26 is operable over a normal range of one hundred to one hundred thirty-four volts A.C. without appreciable damage. For a second, very high input threshold, a level of one hundred forty six volts may be used. Similarly, for a utilization system 26 rated at a nominal 220V A.C., the low voltage thresholds may be 200V and 185V, whereas the high voltage thresholds may be 240V and 255V. Switching circuits 20 and sensor 18 are preferably configured to afford a hysteresis of a few volts to preclude excessive "hunting". The hysteresis may be from two volts to five or more volts.

Figure 3:
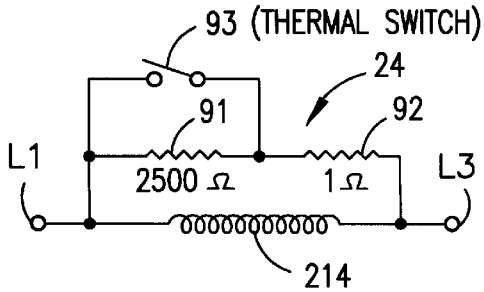
FIG. 3 is a circuit diagram of one embodiment of the bypass protector circuit of FIG. 1.

FIG. 3 affords a simple circuit that can be used for the bypass protector 24. In the form of circuit 24 illustrated in FIG. 3, a first (sensor) resistor 91 and a second (hold) resistor 92 are connected in series with each other across the transformer secondary 214. See FIG. 1. A thermally actuated normally open switch 93 is connected in parallel with resistor 91, as illustrated in FIG. 3; when heat from resistor 91 heats switch 93 above a given temperature the switch 93 closes. The resistor parameters shown in FIG. 3 are for a 240 volt compensation circuit; for a 117 volt compensation circuit, the sensor resistor 91 would be appreciably smaller.

The heat developed in sensor resistor 91 is a function of the square of the current through that resistor multiplied by its resistance. Resistor 91, 2500 ohms in the illustrated circuit, heats rapidly, closing switch 93 and effectively connecting terminals L1 and L3 to bypass transformer secondary 214. The small hold resistance 92, only one ohm, produces only enough heat to hold switch 93 actuated (closed). The purpose of bypass circuit 24 is to keep power "on" to utilization device 26 even if the compensation system 200 fails. If desired, an additional thermal switch (not shown) in the same location as switch 93 can be used for an indicator drive or for an alarm signal indicative of failure of the voltage compensation system 200, FIG. 1.

Figure 4:
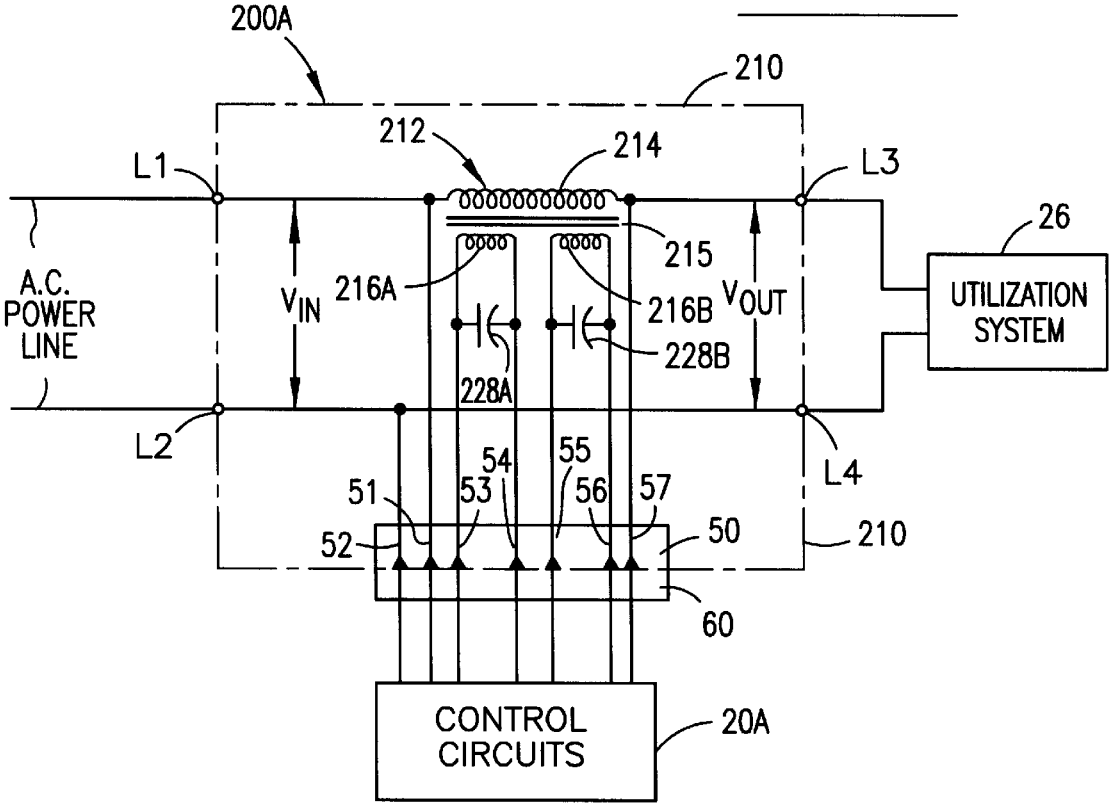
FIG. 4 is a block diagram, like FIG. 1, of another embodiment of the invention.

FIG. 4 is a block diagram, partially schematic, of a voltage compensation system 200A that is essentially similar to system 200 (FIG. 1) described above. System 200A includes the transformer unit 210, with its main transformer 212 (windings 214 and 216A–B, core 215) connected as previously described between two input terminals L1 and L2 and two output terminals L3 and L4. Transformer unit 210 again includes the connector plug 50 with its conductors 51–57 connected as before. Capacitors 228A and 228B, a surge protector 27 and/or a bypass protector 24 (see FIG. 1) may be used if desired.

A second connector 60 again interfits with the transformer unit connector 50. In the system 200A of FIG. 4, however, there is no separate input voltage sensor. Instead, all control functions of sensor 18 and switching circuits 20 of FIG. 1 are combined in a control circuit unit 20A. The connections made within the control circuit 20A of FIG. 4 are the same as described above in regard to FIGS. 2A through 2E, and the operation is essentially as previously described for system 200 of FIG. 1.

Figure 5:
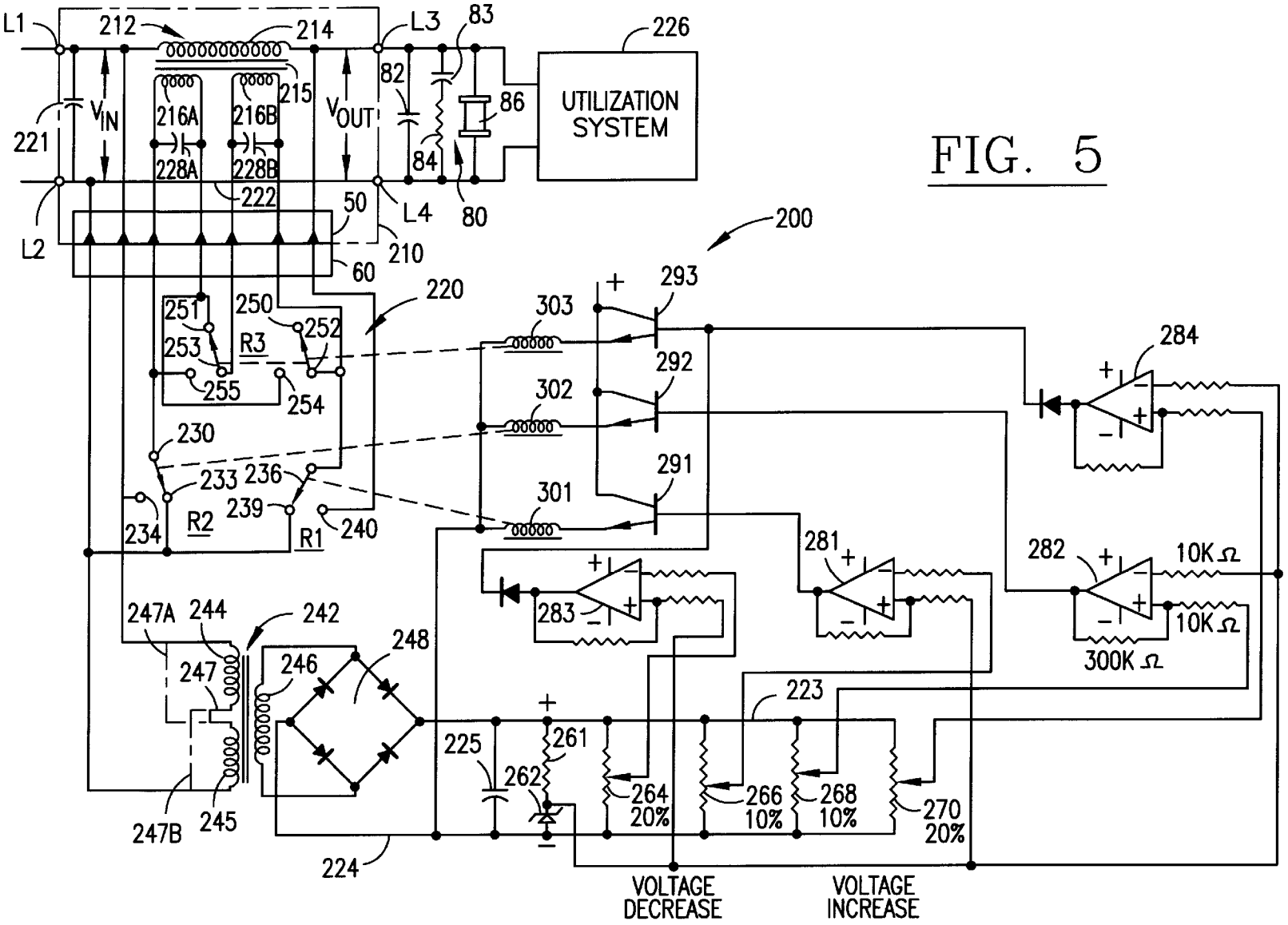
FIG. 5 is a detailed circuit diagram for an embodiment of the invention according to FIG. 1.

FIG. 5 illustrates a voltage compensation system constituting a specific implementation of the system 200 of FIG. 1. System 200 of FIG. 5 may also be considered as an implementation of system 200A, FIG. 4, if the sensor and switching functions are combined in one circuit. System 200, FIG. 5, again compensates for voltage excursions both above and below a normal operating range. Moreover, system 200 is readily adaptable to two different normal input voltage ranges and affords two levels of compensation for both under-voltage and over-voltage conditions.

The system 200 of FIG. 5 includes a transformer unit 210 comprising a main input transformer 212 having a secondary winding 214 connected in series between one input or line terminal L1 and an output terminal L3. In this embodiment the primary winding of transformer 212, which is electromagnetically coupled to the secondary winding 214 by an iron core 215, again includes two separate winding sections or segments 216A and 216B. A capacitor 228A may be connected across winding 216A; a similar capacitor 228B is shown connected in parallel with transformer winding 216B. One end of winding 216A is connected, through connectors 50 and 60, to the movable contact 230 of a single-pole double-throw relay R2 in a switching circuit 220. Relay R2 has two fixed contacts 233 and 234, each engageable by movable contact 230. Fixed contact 234 is connection, through connectors 60 and 50, to one end of transformer winding 214 and to input terminal L1. Fixed contact 233 is connected, by connectors 60 and 50, to input terminal L2.

One end of transformer winding section 216B is connected to the movable contact 236 of another single-pole double-throw relay R1 having two fixed contacts 239 and 240. The fixed contact 239 of relay R1 is connected to input terminal L2. The fixed contact 240 of relay R1 is connected through connectors 60 and 50 to the other end of transformer winding 214 and to the output terminal L3. The fixed contacts 233 (relay R2) and 239 (relay R1) are both connected to a conductor 222 that connects the input terminal L2 to the output terminal L4. A capacitor 221, shown in the upper left-hand corner of FIG. 5, is connected across the input terminals L1 and L2.

The end of transformer winding section 216A that is not connected to the movable contact 230 of relay R2 is connected to one fixed contact 251 of a double-pole double-throw relay R3 that includes two mechanically linked movable contacts 252 and 253. The fixed contact 251 of relay R3 is connected to the right-hand end of the transformer winding segment 216A, the end that is not connected to the movable contact 230 of relay R2. The movable contact 253 is shown engaged with fixed contact 251, but is also engageable with a second fixed contact 255 that is connected to the movable contact 230 of relay R2. The movable contact 252 is shown engaged with an open-circuited fixed contact 250 of relay R3; it is also engageable with another fixed contact 254 of relay R3. Contacts 251 and 254 are interconnected. The movable contacts 252 and 253 of relay R3 are connected to opposite ends of the transformer winding section 216B, with the movable contact 252 of relay R3 also connected to the movable contact 236 of relay R1. In FIG. 5 the contacts of relays R1,R2 and R3 are all shown with the relays unactuated (de-energized), as is the case when the input voltage $V_{IN}$ to FIG. 5 is within the normal operating range for a utilization system 226 connected to output terminals L4 and L3 of the compensation system.

The circuit of FIG. 5 may include a transient filter and suppressor circuit 80 connected between output terminals L3 and L4. Circuit 80 includes the capacitors 82 and 83, with capacitor 83 in series with a resistor 84. Circuit 80 may also include an MOV voltage-breakdown device 86 for transient protection. Suppressor circuit 80 may be physically incorporated in or separate from the switching circuits 220 or transformer unit 210.

The voltage sensor (or controller) circuit in FIG. 5 includes a diode rectifier bridge 248. Bridge 248 is connected across the secondary winding 246 of a sensor transformer 242. The primary winding of transformer 242, as shown, includes two sections 244 and 245 that can be connected in series, as illustrated, as by a shunt 247. Shunt 247 is used when system 205 is employed with an A.C. input line, connected to terminals L1 and L2, having a nominal voltage of 230 volts. By removing shunt 247 and replacing it with two shunts, as indicated by phantom lines 247A and 247B, thus connecting primary winding sections 244 and 245 of transformer 242 in parallel, conversion to operate on an input line having a nominal voltage of 115 volts is easily effected.

The positive (right-hand) terminal of bridge 248 is connected to a conductor 223; the negative terminal of bridge 248 is connected to a conductor 224. A capacitor 225 may be connected between conductors 223 and 224. The series combination of a resistor 261 and a zener diode 262 is also connected between conductors 223 and 224. There are two voltage increase sensor potentiometers 264 (20%) and 266 (10%) and two voltage decrease sensor potentiometers 268 (10%) and 270 (20%), all of the potentiometers being connected across the two conductors 223 and 224. Fixed-tap resistors could be used instead of these control potentiometers.

In the controller circuit shown in FIG. 5 there are four operational amplifiers 281,282,283 and 284, which may all be in one integrated circuit. Each of those amplifiers is connected in a Schmitt trigger configuration with appropriate large resistors in series with the + and − inputs of the amplifier and with a much larger feedback resistor from the amplifier output back to its +input. The exemplary resistance values shown for amplifier 282 may be used for all of the amplifiers. Amplifiers 283 and 284 each have a blocking diode connected to the amplifier output.

The tap of voltage increase potentiometer 264 is connected to the − input of amplifier 283. The tap on the other voltage increase potentiometer 266 is connected to the − input of amplifier 281. The tap on the voltage decrease control potentiometer 268 is connected to the + input of amplifier 282, whereas the tap on the other voltage decrease control potentiometer 270 is connected to the + input of amplifier 284. The remaining input terminals of the amplifiers 281–284 (+ input terminals for 281 and 283, − input terminals for 282 and 284) are all connected to the reference voltage afforded at the junction of resistor 261 and zener diode 262.

The output of amplifier 281 is connected to the base of a transistor 291. The collector of transistor 291 is connected to the positive voltage supply (conductor 223). The emitter of transistor 291 is connected to one end of the operating coil 301 for the relay R1. The other end of coil 301 is returned to conductor 224. The output circuit for amplifier 282 is essentially similar. It includes a transistor 292 having its emitter connected to the operating coil 302 of relay R2, its collector connected to the + supply, and its base connected to the output of amplifier 282. Each of the two amplifiers 283 and 284 has its output connected to the base of a transistor 293. The emitter of transistor 293 is connected to the operating coil 303 of the relay R3. The contacts of relays R1–R3, and their connections, have previously been described.

Operation of the system 200 of FIG. 5 is essentially similar to previously described embodiments of the invention as described and illustrated by FIGS. 1 and 4. FIG. 5 shows the positions of the movable relay contacts 230,236, 252 and 253 when the input voltage $V_{IN}$ across line terminals L1 and L2 is within the normal range for operation of the utilization system 226. The primary winding sections 216A and 216B of the transformer 212 in the voltage control or switching circuit 220 are both connected to line 222, through the contacts of relays R1 and R2. The outputs from the potentiometers 264,266,268 and 270 are normally not sufficient to actuate any of the Schmitt trigger circuits comprising amplifiers 281–284. The relay coils 301–303 remain unenergized and the output voltage $V_{OUT}$ across the output terminals L3 and L4 is approximately the same as the input voltage $V_{IN}$ at the input terminals L1 and L2. It is assumed that the normal input voltage $V_{IN}$ is centered around 230V and does not drop more than 10% (207V) or rise more than 10% (253V). As long as the input voltage $V_{IN}$ remains within the limits of 207V to 253V, the device 200 has no measurable effect on the operation of system 226.

Figure 6A:
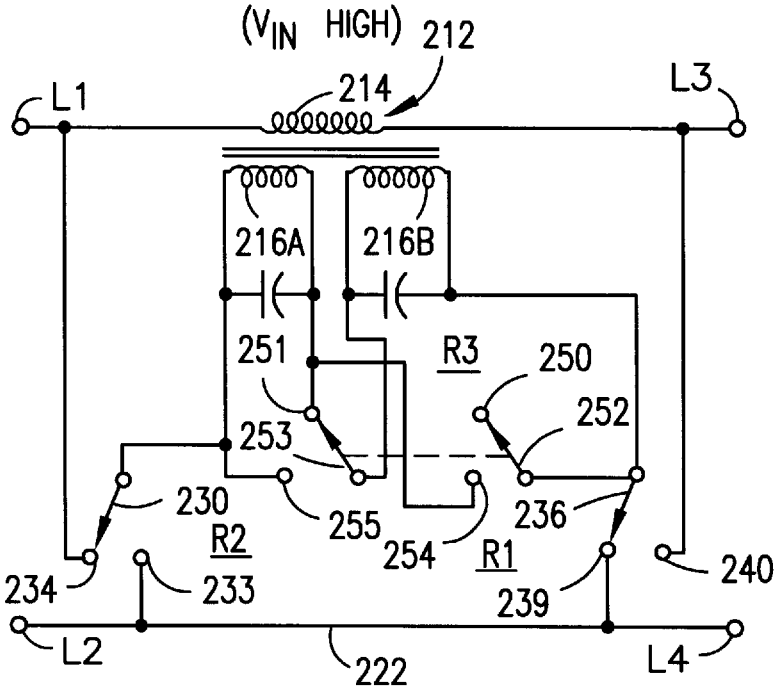
FIGS. 6A, 6B, 6C and 6D are circuit drawings illustrating the relay connections for a transformer in the circuit of FIG. 5 for high, very high, low and very low input voltages, respectively.

Consider, then, the situation that obtains when the input voltage goes above the upper threshold, 253V, of the normal range, but is less than a 20% increase, which would be 276V. The outputs of potentiometers 264,266 and 270 do not actuate the Schmitt trigger circuits to which they are connected. But the output from potentiometer 268 is now adequate to energize the operating coil 302 of relay R2, through amplifier 282 and transistor 292, and actuates relay R2. This produces the operating condition shown in FIG. 6A; only relay R2 is actuated, its movable contact 230 disengaging from its fixed contact 233 and engaging its contact 234. The primary winding segments 216A and 216B of transformer 212 are now connected in series with each other. The voltage the primaries 216A and 216B induce in the secondary winding 214 of transformer 212 (FIG. 5) is in bucking relation to the input voltage and maintains the output voltage $V_{OUT}$ to system 226 within its "normal" range.

Figure 6B:
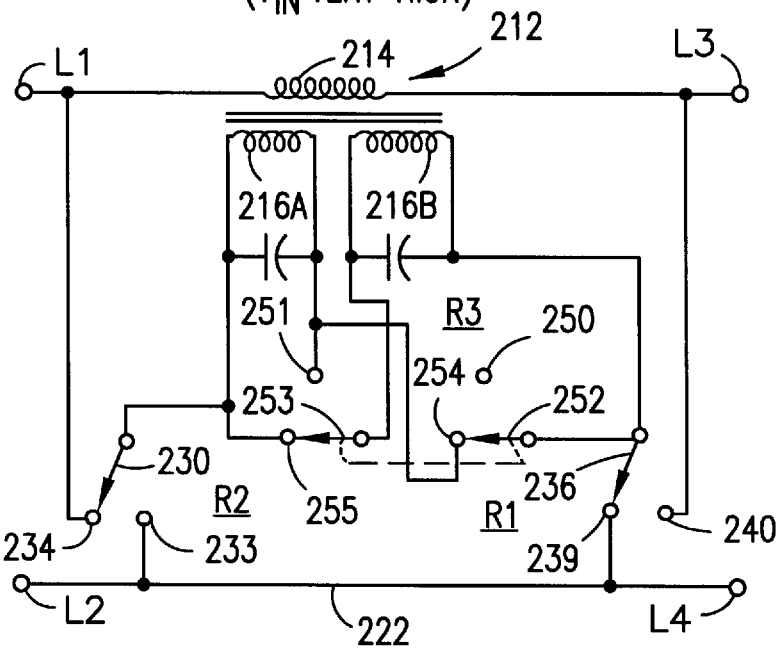

A further increase in the input voltage may well occur, to a level above the 20% threshold of 276V. In that event, potentiometer 270 and its Schmitt trigger circuit comprising amplifier 284 and transistor 293 energize coil 303 of relay R3, FIG. 5. Relay R3 is now actuated, and relay R2 remains actuated. This is the operating condition shown in FIG. 6B. The primary winding sections 216A and 216B of transformer 212 are each connected across the line terminals leading to the load, system 226 (FIG. 5), but now they are in parallel with each other rather than in series. They are still in bucking relation; the voltage they induce in transformer winding 214 subtracts from the over-voltage at $V_{IN}$. System 200, FIG. 5, continues to maintain the input voltage to system 226 within its desired range.

Figure 6C:
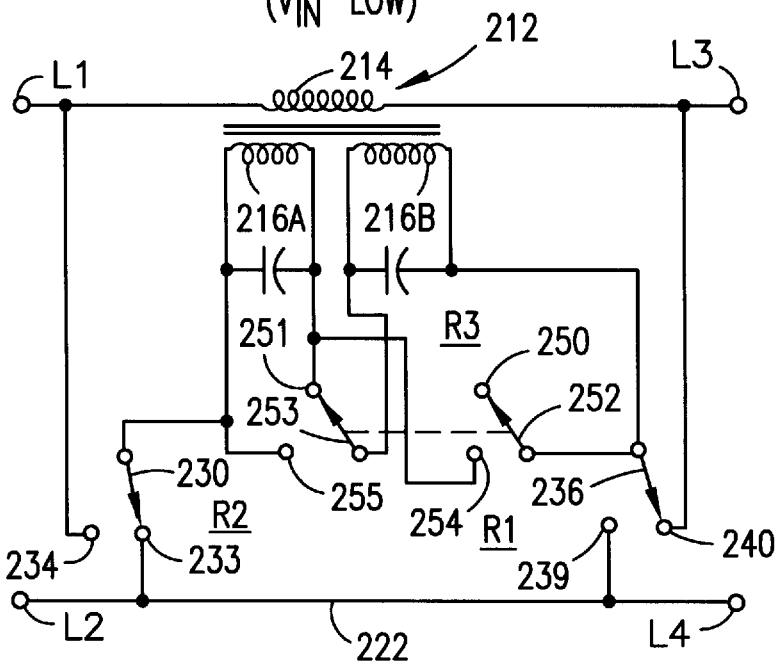

Another condition that may occur is a drop in the input voltage to a level below a 10% threshold (207V) but still above a 20% threshold (184 V). This results in energization of only the operating coil 301 of relay R1 by means of potentiometer 266 and the circuit comprising amplifier 281 and transistor 291 (FIG. 5). The other relay coils 302 and 303 remain de-energized. The resulting condition, shown in FIG. 6C, has the primary windings 216A and 216B energized in series but in the opposite sense from that described above for FIG. 6A. That is, the induced voltage in the secondary winding 214 of transformer 212 adds to (increases) the output voltage $V_{OUT}$ supplied to utilization system 226, FIG. 5.

Figure 6D:
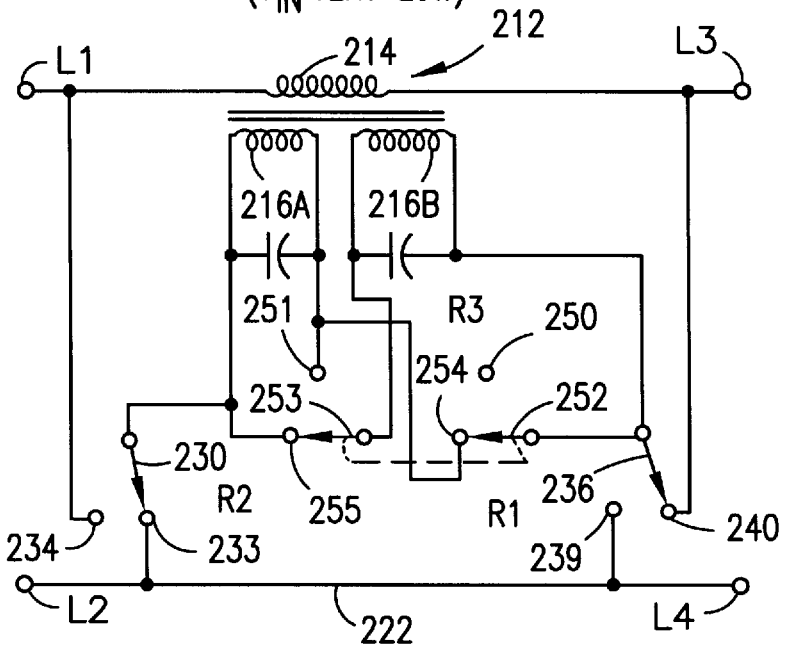

FIG. 6D shows the remaining condition, when relay R1 is still energized, as described immediately above, but the input voltage $V_{IN}$ drops below a 20% threshold, to less than 184V. When this occurs, the operating coil 303 of relay R3 is again energized, this time by the circuit comprising potentiometer 264, amplifier 283, and transistor 293, FIG. 5. With relays R1 and R3 both actuated, as shown in FIG. 6D, the primary winding sections 216A and 216B are still energized but are connected in parallel rather than series. The system 200 (FIG. 5) continues to maintain the output voltage to system 226 within its normal range.

To summarize operation of system 200 in the configuration shown in FIG. 5, whenever there is an under-voltage condition at input terminals L1, L2 between 10% and 20% below the normal range centered on a nominal voltage of 230V, the primary winding sections 216A and 216B of the main transformer 212 are connected in series and in additive relation relative to the secondary transformer winding 214.

For an even greater under-voltage condition, more than 20%, the primary windings are connected in parallel. For over-voltage conditions, the action is the same except that the primary windings are in bucking relation to the secondary winding in the main transformer 212. In either case, if the under-voltage or over-voltage condition abates, the relays R1–R3 are de-energized and return to the operating condition illustrated in FIG. 5. The utilization system 226 is always supplied with an energizing voltage within its normal range.

The foregoing discussion assumes that the tolerance of system 226 for over-voltage and under-voltage conditions is symmetrical about some nominal voltage, taken as 230V for FIG. 5. Such symmetry may not obtain; the permissible lower threshold for the normal range may be greater than the permissible higher threshold, or vice versa. An asymmetrical situation is readily met by adjustment of the sensor potentiometers 264,266,268 and 270 to suit the needs of utilization system 226. Similar adjustment for other embodiments of the invention is equally convenient. In all instances, some limited hysteresis in the sensing and relay actuation portions of the compensation system is desirable to preclude "hunting".

The system 200 as illustrated in FIG. 5 is readily adaptable to the configuration shown in FIG. 1. The main transformer 212 of FIG. 5 is incorporated in a transformer unit directly corresponding to the unit 210 of FIG. 1, with input terminals L1 and L2, output terminals L3 and L4, and the transformer 212 itself. The circuits in FIG. 5 constitute an input voltage sensor directly equivalent to sensor 18 of FIG. 1. Interposition of the power supply circuits comprising bridge 248 and transformer 242 leave the voltage across conductors 23 and 224 directly representative of the input voltage $V_{IN}$. Actuating signals are supplied to the switching (relay) circuits. The relay circuits in FIG. 5 afford an example of the kind of switching circuits 20 required for the compensation system 200 of FIG. 1.

FIGS. 7A through 7E illustrate, schematically, a series of connector plugs 60A through 60E, respectively, that may be employed in the systems illustrated in FIGS. 1 and 4 in situations in which only limited dynamic control is provided for line voltage fluctuations.

Figure 7A:
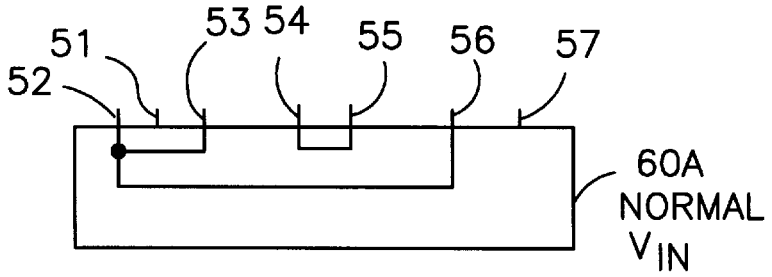
FIGS. 7A, 7B, 7C, 7D and 7E illustrate schematic plug constructions for chronic input voltage conditions corresponding to normal, high, very high, low and very low input voltage conditions, respectively.

FIG. 7A illustrates a connector plug 60A that is employed to maintain system 200, for example, in the "normal" mode shown in FIG. 1. In connector 60A, the input connection 52 is electrically connected to the connections 53 and 56. Inputs 54 and 55 are electrically interconnected. Input connections 51 and 57 remain open-circuited. Thus, if sensor 18 and switching circuit unit 20 are omitted from the system 200 shown in FIG. 1, and plug 60 is replaced by plug 60A of FIG. 7A, the transformer primary windings are connected in series. However, that series combination of primary winding sections is effectively shorted out, since both ends (connections 53 and 56) are connected to line 22 by way of connection 52. The compensation system 200, when thus modified, does not alter the input voltage to utilization system 26, FIG. 1.

Figure 7B:
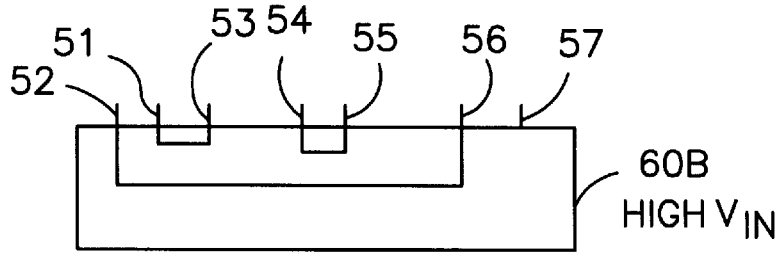

If connector plug 60B of FIG. 7B is used instead of plug 60, however, the result is quite different. In connector 60B, input connection 52 is electrically connected to input connection 56, input connections 51 and 53 are electrically interconnected, and input connections 54 and 55 are electrically interconnected. Input connection 57 remains open-circuited. This is like the high-voltage conditions of FIGS. 2D and 6A, with the primary winding segments 216A and 216B of the main transformer connected in series and in bucking relation to the voltage of the transformer secondary winding 214. Connector 60B is used for an A.C. input line that exceeds the normal range for the utilization system 26 (or 226) by no more than 10%, or some other like intermediate high threshold voltage.

Figure 7C:
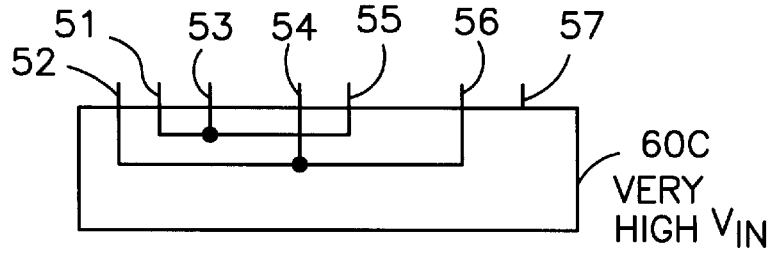

Connector 60C of FIG. 7C has its input connection 52 electrically interconnected with its input connections 54 and 56. Further, in connector 60C input connection 51 is electrically connected to the input connections 53 and 55. Connection 57 remains open-circuited. This results in connections, for the main transformer unit, like those shown in FIGS. 2E and in FIG. 6B. Plug 60C thus affords connections for the main transformer 212 that conform to those appropriate for a sustained over-voltage condition $V_{IN}$ exceeding a predetermined threshold (e.g., 20%).

Figure 7D:
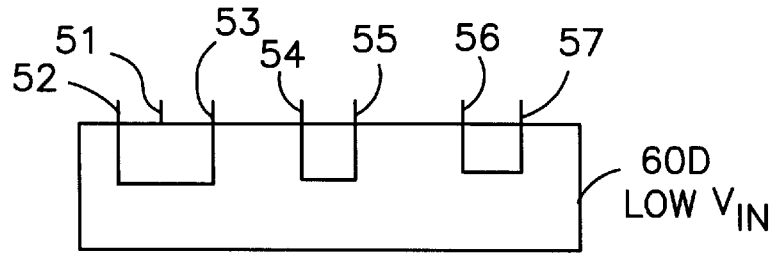
Figure 7E:
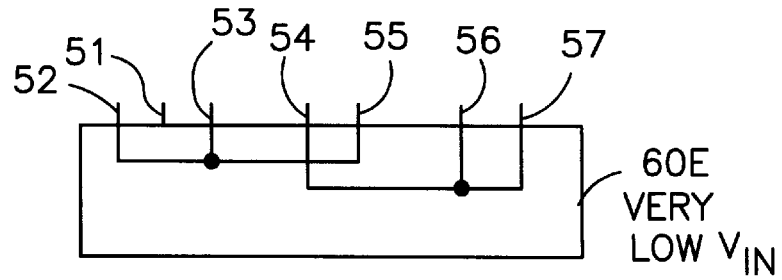

In connector plug 60D, FIG. 7D, the electrical interconnections are from 52 to 53, from 54 to 55, and from 56 to 57, with connection 51 left open circuited. This is equivalent to the circuit connections illustrated in FIGS. 2B and 6C, appropriate for a sustained low-voltage A.C. input, below a 10% voltage reduction and above a 20% voltage reduction. Connector plug 60E of FIG. 7E, on the other hand, has its input connection 52 electrically connected to 53 and 55, its input connection 54 electrically joined to 56 and 57, and 51 again left open circuited. This is electrically the same as the very low A.C. input voltage $V_{IN}$ situations previously described for FIGS. 2C and 6D. Plug 60E is thus appropriate for a sustained low input voltage, exceeding 20% in the examples described.

Plugs 60A through 60E, FIGS. 7A–7E are much less costly and may be appreciably smaller than the equivalent sensor and/or control circuits. Their disadvantage is that they do not handle all variable voltage conditions for the input A.C. line. However, if a chronic or permanent over-voltage or under-voltage condition is anticipated or encountered, they may constitute the best remedy available at the least cost.

Figure 8:
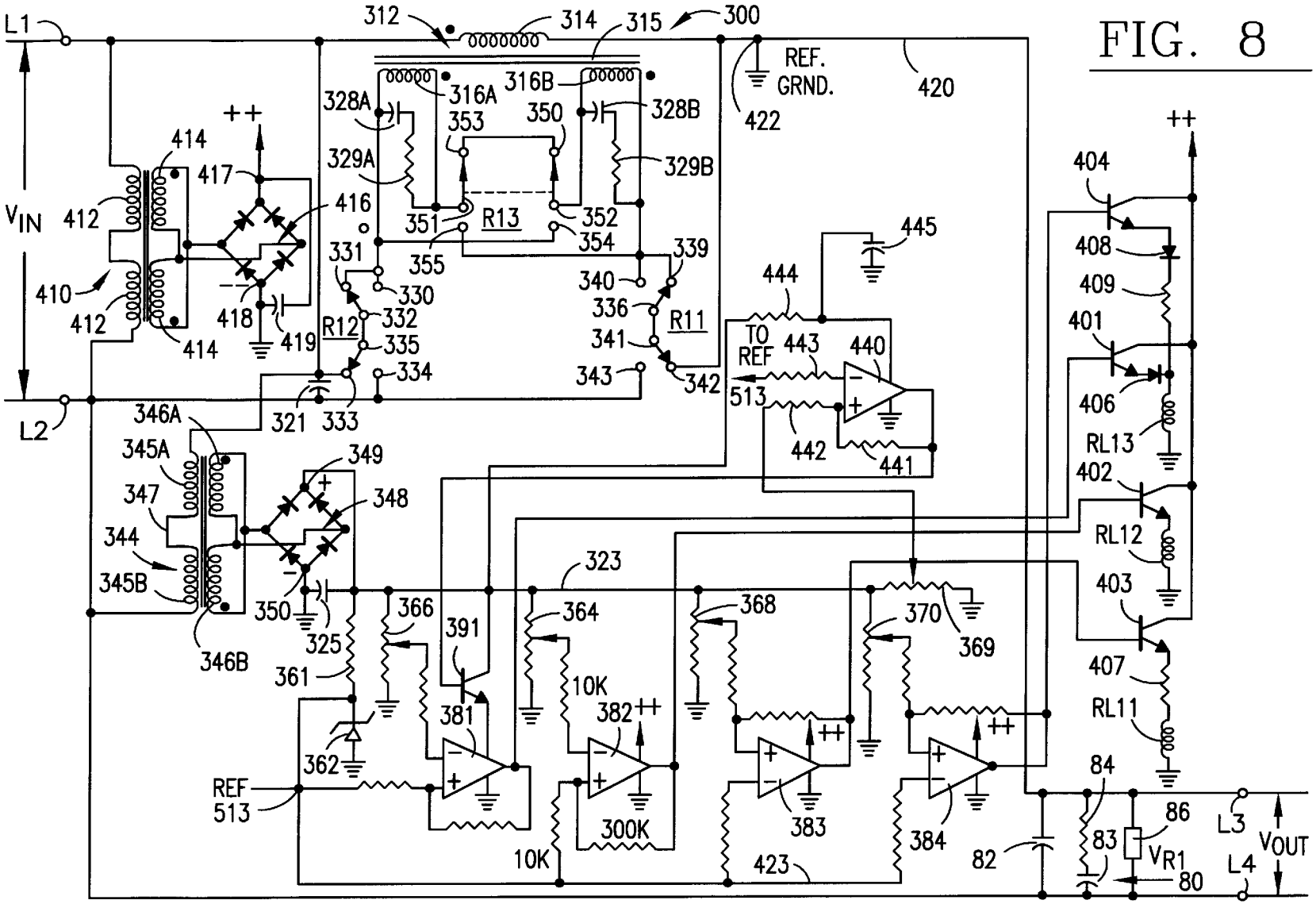
FIG. 8 is a detailed circuit diagram of yet another embodiment of the invention.

FIG. 8 illustrates a voltage compensation system 300; system 300 again compensates for line voltage ($V_{IN}$) excursions in two ranges above and in two ranges below a normal operating range. System 300 includes a main input transformer 312 having a secondary winding 314 connected in series between an input terminal L1 and an output terminal L3. The primary winding of transformer 312 is electromagnetically coupled to the secondary winding 314 by a core 315; the primary winding includes two separate winding segments 316A and 316B. The series combination of a capacitor 328A and a resistor 329A is connected across primary winding section 316A; a similar capacitor and series resistor combination 328B and 329B is connected in parallel with the other transformer primary winding section 316B.

One end of primary winding segment 316A is connected to the fixed contacts 330 and 331 of one side of a double-pole double-throw relay R12. Relay R12 has a movable contact 332 engaging fixed contact 331 when the relay is unactuated (de-energized); movable contact 332 engages fixed contact 330 when relay R12 is actuated, as described hereinafter. Relay R12 also has two further fixed contacts 333 and 334, each engageable by a second movable contact 335. Relay contacts 330 and 331 are electrically connected. Fixed relay contact 333, engaged by movable contact 335 when relay R12 is not actuated, is connected to input terminal L1. Fixed contact 334, on the other hand, is connected to the other input terminal L2. A capacitor 321 may be connected across input terminals L1 and L2.

The end of main transformer winding segment 316A that is not connected to the contacts 330 and 331 of relay R12 is connected to one movable contact 351 of a double-pole double-throw relay R13 that includes two mechanically linked movable contacts 351 and 352. Movable contact 351 is normally engaged with a fixed contact 353, as shown; that is the unactuated (de-energized) condition for relay R13. The movable contact 351 is also engageable with a second fixed contact 355. The other movable contact 352 of relay R13, shown engaged with a fixed contact 350, is also engageable with another fixed contact 354 of relay R13. The movable contact 352 of relay R13 is connected to the left-hand end of the transformer winding 316B.

The right-hand end of the primary winding segment 316B of transformer 312B is connected to the contacts 339 and 340 of another double-pole double-throw relay R11 having a movable contact 336. The fixed contacts 339 and 340 of relay R11 are also connected to the fixed contact 355 of relay R13. Relay R11 has a second movable contact 341 engageable with two fixed contacts 342 and 343. The fixed contact 342 of relay R11 is connected to the output terminal L3 and the fixed contact 343 of relay R11 is connected to the fixed contact 334 of relay R12 and to input terminal L2. The fixed contacts 330 and 331 of relay R12 are both connected to the fixed contact 354 of relay R13. The movable contacts 332 and 335 of relay R12 are electrically and mechanically interconnected; the movable contacts 336 and 341 of relay R11 are similarly interconnected. Further, the fixed contacts 350 and 353 of relay R13 are electrically interconnected. In FIG. 8 relays R11, R12 and R13 are all shown unactuated (deenergized); this condition applies when the input voltage $V_{IN}$ to system 300 of FIG. 8 is within the normal operating range for a utilization system (not shown) connected to its output terminals L4 and L3.

The circuit of FIG. 8 may include a transient filter and suppressor circuit 80 connected between output terminals L3 and L4. Circuit 80 includes the capacitors 82 and 83 and a resistor 84 connected in series with capacitor 83. Circuit 80 may also include a voltage-breakdown device 86 for transient protection.

The system 300 of FIG. 8 includes a diode rectifier bridge 348 used as part of an input voltage sensor. Bridge 348 is connected to the secondary windings 346A and 346B of an input voltage level sensor transformer 344. The primary winding of sensor transformer 344 includes two sections 345A and 345B that can be connected in series, as shown, as by a shunt 347. Shunt 347 is used when system 300 is employed with an A.C. input line connected to terminals L1 and L2 that has a nominal voltage of 220 to 240 volts. By removing shunt 347 and replacing it with two shunts, as described above in connection with transformer 242 in FIG. 5, connecting primary winding sections 345A and 345B in parallel, conversion to operate on an input line having a nominal voltage of 110–120 volts is readily effected.

The positive terminal 349 of bridge 348 is connected to a conductor 323; the negative terminal 350 of the bridge is returned to system ground. A capacitor 325 is connected between the bridge terminals 349 and 350. The series combination of a resistor 361 and a zener diode 362 is connected from conductor 323 to system ground. As in FIG. 5, there are two voltage increase sensor potentiometers 364 (20%) and 366 (10%) and two voltage decrease sensor potentiometers 368 (10%) and 370 (20%). All of these potentiometers are connected from the conductor 323 to system ground. Conductor 323 may be terminated by a connection through a resistor 369 (shown as a potentiometer) to system ground. Fixed-tap resistors may be used instead of the potentiometers.

In compensation system 300, FIG. 8, there are four operational amplifiers 381,382,383 and 384; all may be incorporated in one integrated circuit. Each amplifier 381–384 is connected in a Schmitt trigger configuration with appropriate resistors in series with the + and − inputs of the amplifier and with a much larger feedback resistor from the amplifier output back to its + input. The exemplary resistance values shown for amplifier 382 may be used for all of the amplifiers 381–384.

The tap on the voltage increase sensor potentiometer 366 is connected to the input of amplifier 381. The tap on the other voltage increase potentiometer 364 is connected to the − input of amplifier 382. The tap on the voltage decrease sensor potentiometer 368 is connected to the + input of amplifier 383, whereas the tap on the other voltage decrease sensor potentiometer 370 is connected to the + input of amplifier 384. The remaining input terminals of the amplifiers 381–384 (+ input terminals for 381 and 382, − input terminals for 383 and 384) are all connected, by a conductor 423, to the reference voltage at a terminal 513 that is connected to the junction of resistor 361 and zener diode 362.

The amplifier 381 is connected to the emitter of a normally non-conductive switching transistor 391; amplifier 381 has another connection to system ground. The collector of switching transistor 391 is connected to conductor 323. The base of transistor 391 is connected to the output of another Schmitt trigger circuit, comprising an amplifier 440, described hereinafter.

The output of Schmitt trigger amplifier 381 is connected to the base of a transistor 401 at the right-hand side of FIG. 8. The collector of transistor 401 is connected to the positive voltage supply ++. The emitter of transistor 401 is connected through a blocking diode 406 to one end of the operating coil RL13 for the relay R13. The other end of relay operating coil RL13 is returned to system ground. The output circuit for amplifier 382 is similar; it includes a transistor 402 having its emitter connected directly to one end of the operating coil RL12 for relay R12. The other end of coil RL12 is returned to ground. The collector of transistor 402 is connected to the ++ supply. Amplifier 383 has its output connected to the base of a transistor 403. The emitter of transistor 403 is connected to the operating coil RL11 of the relay R11 through a resistor 407. The other end of coil RL11 is returned to system ground. The output of amplifier 384 is connected to the base of a transistor 404. The collector of transistor 404 is connected to the ++ positive supply. The emitter of transistor 404 is connected to one end of the operating coil RL13 of relay R13 through the series combination of a blocking diode 408 and a resistor 409. As previously noted, the other end of coil RL13 is grounded. The operational amplifiers 382–384 all have input connections to the ++ supply and to ground.

The ++ positive power supply for transistors 401–404 and amplifiers 382–384 of system 300, FIG. 8, comprises a power supply transformer 410 in the upper lift portion of the figure. Transformer 410 has dual-section primary and secondary windings 412 and 414; both transformer windings are shown with their winding sections series connected. The primary winding 412 of transformer 410 is connected across the input terminals L1 and L2 of system 300. A diode rectifier bridge 416 having a positive output terminal 417 and a negative output terminal 418 is connected to the secondary 414 of transformer 410. The negative-polarity terminal 418 of bridge 416 is grounded. The positive-polarity terminal 417 is coupled to ground through a capacitor 419. The positive terminal 417 of bridge 416 is the ++ power supply.

The voltage compensation system 300 of FIG. 8 includes another operational amplifier 440 having its output connected to the base of transistor 391 in the circuit of amplifier 381. The output of amplifier 440 is also connected back to the + input of amplifier 381 through a large feedback resistor 441. The + input of amplifier 440 is also connected to the tap of potentiometer 369 through a series resistor 442. The input of amplifier 440 is connected to the reference terminal 513 in the inputs to amplifiers 381–384 through a series resistor 443. Amplifier 440 also has a connection through a resistor 444 to conductor 323; the same connection from amplifier 440 is coupled to system ground by a capacitor 445. Amplifier 440, like the operational amplifiers 381–384, is connected in a Schmitt trigger configuration.

The conductor 420 of FIG. 8, with secondary winding 314 of main transformer 312 in series therein, connects input terminal L1 to output terminal L3 of system 300.

The other input terminal L2 is connected directly to output terminal L4 by a conductor 421. Reference ground for system 300 is taken at the L3 end of conductor 420, as indicated at terminal 422.

The operation of the system 300 of FIG. 8 is similar to that of previously described embodiments of the invention. FIG. 8 shows the relationships of the contacts of relays R11, R12 and R13 when the input voltage $V_{IN}$ across line terminals L1 and L2 is within the normal range for operation of a utilization system; none of the relays R11–R13 has been actuated (energized) in FIG. 8. The primary windings 316A and 316B of the main transformer 312 are both connected to line 420, through the contacts of the relays R11–R13. With $V_{IN}$ in the normal voltage range for a utilization system connected to output terminals L3 and L4 the outputs from potentiometers 364,366,368 and 370 are not sufficient to actuate any of the Schmitt trigger circuits comprising amplifiers 381–384. The Schmitt trigger circuit comprising amplifier 440 does not drive transistor 391 to conduction for this condition. The relay coils RL11, RL12 and RL13 remain unenergized and the output voltage $V_{OUT}$ across the output terminals L3 and L4 is approximately the same as the input voltage $V_{IN}$ at the input terminals L1 and L2. It is assumed that the input voltage $V_{IN}$ is centered around 230V and does not drop more than 10% (207V) or rise more than 10% (253V). As long as the input voltage $V_{IN}$ remains within the normal range between these thresholds, 207V to 253V, system 300 has no appreciable effect on the operation of a utilization system connected across its output terminals L3 and L4.

Figure 9A:
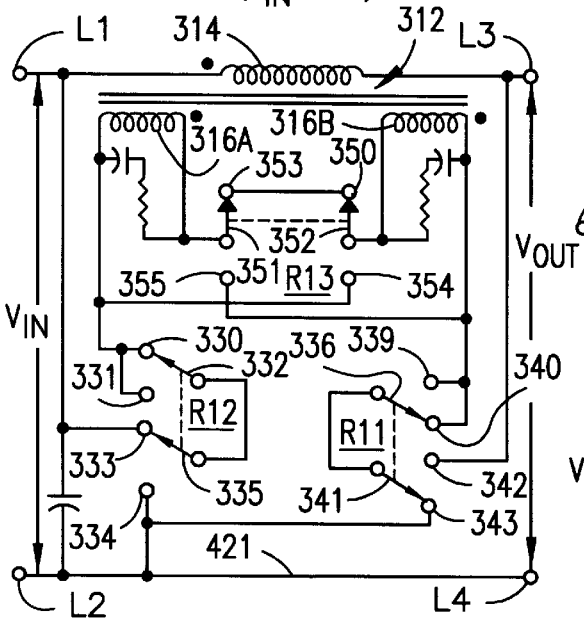
FIGS. 9A, 9B, 9C and 9D illustrate the circuit connections for the primary winding of the main transformer in the circuit of FIG. 8 for low, very low, high and very high input voltages, respectively.

Consider, then, the situation that obtains in system 300 (FIG. 8) when the input voltage $V_{IN}$ drops below the lower threshold, 207V, of the normal range, but is less than a 20% decrease, which would be 184V. The outputs of potentiometers 364,366 and 370 do not actuate the Schmitt trigger circuits comprising amplifiers 381–383, to which they are connected. But the output from potentiometer 368 is now adequate to energize the operating coil RL11 of relay R11 and actuates that relay. This produces the operating condition for a low $V_{IN}$ illustrated in FIG. 9A; only relay R11 is actuated because only relay coil RL11 is energized. Movable contact 336 is disengaged from its fixed contact 339 and engages its fixed contact 340 in relay R11. The movable contact 341 of relay R11 has also moved from fixed contact 342 to fixed contact 343. The primary windings 316A and 316B of transformer 312 are now connected in series with each other across terminals L1 and L2. The voltage that the primary transformer winding sections 316A and 316B induce in the secondary winding 314 of transformer 312 is in adding relation to the input voltage and maintains the output voltage $V_{OUT}$ within its "normal" range.

Figure 9C:
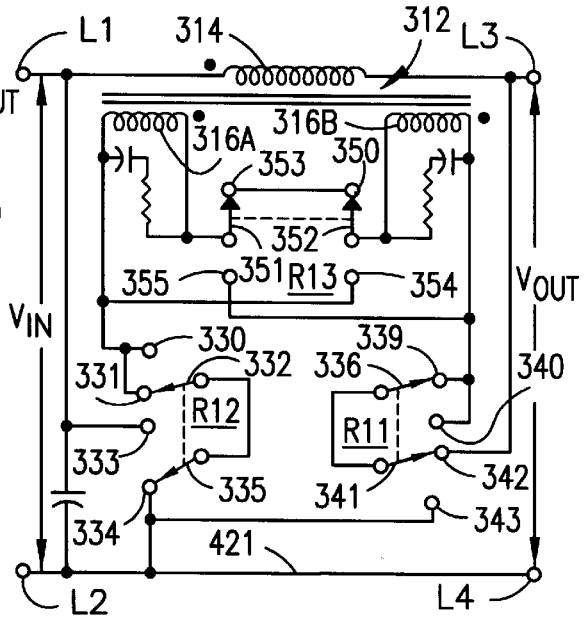

A further decrease in the input voltage may well occur, to a level more than 10% below the initial 10% low-voltage threshold of 207V. The Schmitt trigger circuit comprising amplifier 440 then drives switching transistor 391 to conduction. With the voltage input $V_{IN}$ now below 184V, potentiometer 370 and its Schmitt trigger circuit comprising amplifier 384 energize coil RL13 of relay R13. Relay R13 is now actuated; relay R11 remains actuated. This is the operating condition shown in FIG. 9B for a very low $V_{IN}$ condition, with relays R11 and R13 both actuated but with relay R12 still in its original unactuated state. The primary windings 316A and 316B of transformer 312 are each connected across the line terminals but now they are in parallel with each other rather than in series as in FIG. 9A. They are still in adding relation; the voltage they induce in winding 314 of transformer 312 adds to the under-voltage at $V_{IN}$. System 300 continues to maintain the $V_{OUT}$ voltage to a utilization system connected to terminals L3 and L4 within its desired range.

Another condition that may occur is an increase in the input voltage $V_{IN}$ to a level above the 10% upper threshold (253V) but still below the 20% upper threshold (276 V). This results in energization of only the operating coil RL12 of relay R12 by means of potentiometer 364 and amplifier 382 (FIG. 8). The other relay coils RL11 and RL13 remain de-energized. The resulting condition, shown in FIG. 9C, has the primary windings 316A and 316B energized in series but in the opposite sense from that described above for FIG. 9A. That is, the induced voltage in the secondary winding 314 of main transformer 312 bucks (decreases) the output voltage $V_{OUT}$ supplied to the utilization system.

Figure 9D:
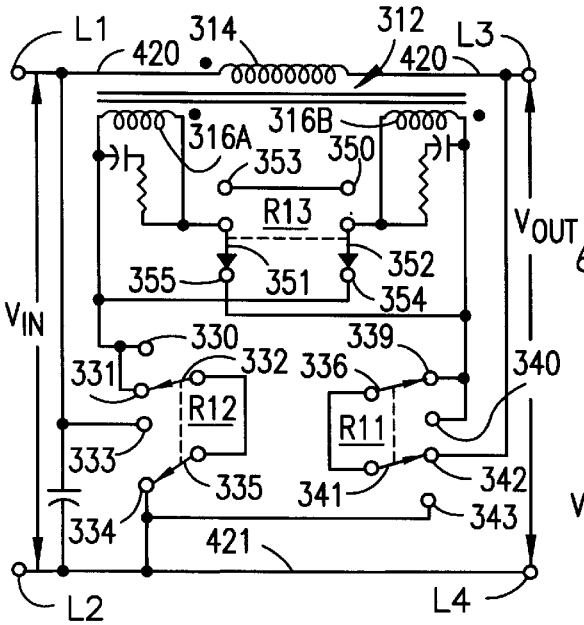
Figure 9B:
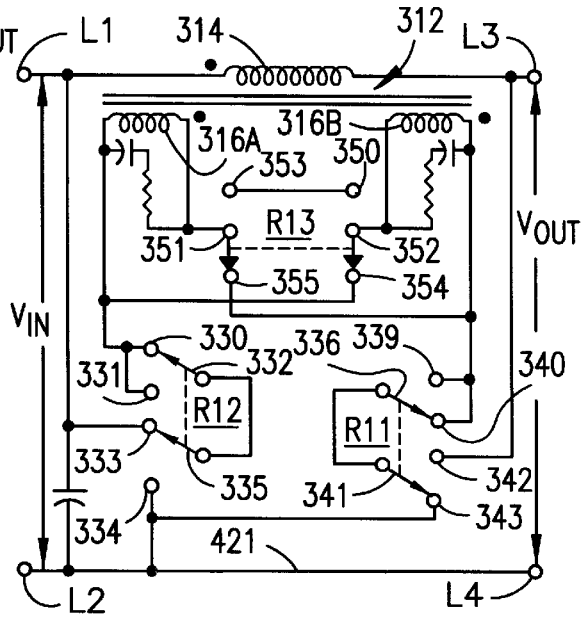

FIG. 9D shows the remaining condition, with $V_{IN}$ very high. The relay R12 is still energized, as described immediately above, but the input voltage $V_{IN}$ has increased above a 20% threshold, to some level greater than 276V. When this occurs, the operating coil RL13 of relay R13 is again energized, this time by the circuit comprising potentiometer 370, amplifier 384, and transistor 404, FIG. 8. With relays R12 and R13 both actuated, as shown in FIG. 9D, the primary windings 316A and 316B are still energized, but they are in parallel rather than series. System 300 (FIG. 8) continues to maintain the output voltage $V_{OUT}$ to its utilization system, across terminals L3 and L4, within its normal range.

To summarize operation of system 300, FIG. 8, whenever there is an under-voltage $V_{IN}$ condition at terminals L1, L2, between 10% and 20% below a normal range centered on a nominal voltage (taken as 230V), the primary windings 316A and 316B of the main transformer 312 are connected in series and in additive relation relative to the secondary winding 314 of transformer 312. See FIG. 9A. For an even lower under-voltage $V_{IN}$ condition, more than 20% below the normal range, the primary windings 316A and 316B are connected in parallel rather than in series. See FIG. 9B. For an over-voltage $V_{IN}$ condition, the action is the same except that the primary windings are in bucking relation to the secondary winding 314 of the transformer 312. In either case, if the under-voltage or over-voltage condition abates, relays R11, R12 and R13 are de-energized and return to the normal operating condition illustrated in FIG. 8, with the primary winding sections 316A, 316B of transformer 312 effectively disconnected; they are shorted out. A utilization system connected to terminals L3 and L4 is supplied with an energizing voltage within its normal range despite wide variations in the A.C. line input voltage $V_{IN}$.

The foregoing discussion of FIG. 8 again assumes that the tolerance of the utilization system for over-voltage and under voltage conditions is generally symmetrical about some nominal voltage, taken as 230V for FIG. 8. Such symmetry may not prevail; the permissible lower threshold for the normal range may be greater than the permissible higher threshold, or vice versa. An asymmetrical situation of this kind is readily met by adjustment of the sensor potentiometers 364,366,368 and 370 to suit the needs of a utilization system connected to output terminals L3 and L4. In all instances, some limited hysteresis in the sensing and relay actuation circuits of the compensation system 300 is desirable to preclude "hunting".

Figure 10:
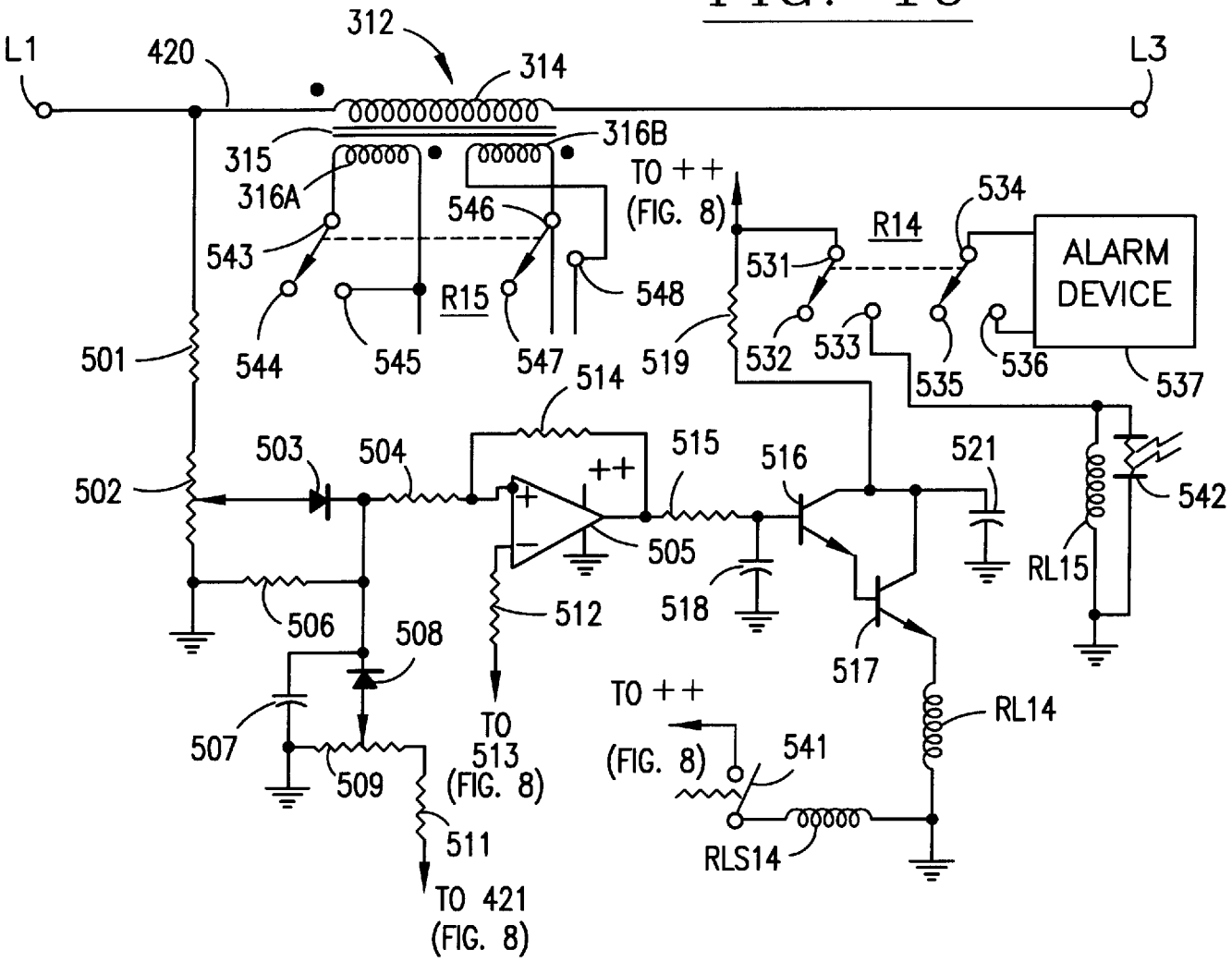
FIG. 10 is a circuit diagram of an additional safety circuit for the embodiment of FIG. 8.

FIG. 10 illustrates an additional safety circuit 500 for the compensation system 300 of FIG. 8. Some of the circuit components of FIG. 8 are shown in FIG. 10 to help orient circuit 500 in relation to system 300. The safety circuit 500 guards against failure of the compensation system 300.

Safety circuit 500 comprises a resistor 501 at the left-hand side of FIG. 10. Resistor 501 has one end connected to conductor 420 on the input side of the main transformer secondary winding 314. The other end of resistor 501 is returned to system ground through a potentiometer 502. The tap of potentiometer 502 is connected, through a diode 503 and a series resistor 504, to the + input of an operational amplifier 505. The junction between diode 503 and resistor 504 is returned to ground through a resistor 506. A capacitor 507 is connected in parallel with resistor 506. The junction between diode 503 and resistor 504 is also connected through another diode 508 to the tap on a potentiometer 509; one end of potentiometer 509 is connected to system ground and the other end is connected, through a resistor 511, to the conductor 421 (FIG. 8).

The amplifier 505 has its – input connected, through a resistor 512, to the reference terminal 513 in system 300, FIG. 8. A feedback resistor 514 is connected from the output of amplifier 505 (FIG. 10) back to its + input. The output of amplifier 505 is also connected through a resistor 515 to the base of a transistor 516 that is connected in Darlington configuration with another transistor 517. The base of transistor 516 is also coupled to system ground by a capacitor 518. The collectors of transistors 516 and 517 are connected to the ++ power supply (FIG. 8) by a resistor 519 and are coupled to system ground by a capacitor 521. The emitter of transistor 516 is connected to the base of transistor 517; the emitter of transistor 517 is connected to one end of a first relay operating coil RL 14.

The other end of coil RL14 is returned to system ground. Coil RL14 is part of a double-pole double-throw latching relay R14 having a first movable contact 531 normally engaging a fixed open-circuited contact 532 but engageable with another fixed contact 533 when relay R14 is actuated. Relay R14 includes a second movable contact 534 which is normally engaged with an open-circuited fixed contact 535 but which is engageable with another fixed contact 536 when relay R14 is actuated. The movable contacts 531 and 534 of relay R14 are mechanically connected for joint horn, siren, warning lamp, or other alarm device 537 has inputs connected to the fixed contact 536 and to the movable contact 534 of relay R14.

Relay R14 (FIG. 10) also has a second operating coil RLS14 connected through a normally open momentary contact switch 541 to the ++ voltage supply (see FIG. 8). Coil RLS14 is employed to reset relay R14; it serves to hold open the relay after they have been actuated by energization of the first operating coil RL14 of relay R14 and that coil RL14 has subsequently been de-energized.

Safety circuit 500, FIG. 10, further includes the operating coil RL15 of a double-pole double-throw relay R15 having a movable contact 543 and fixed contact 544 connected in series with one end of section 316A of the primary winding of the main transformer 312 in compensation system 300; see also FIG. 8. As also shown in FIG. 10, another movable contact 546 and fixed contact 548 of relay R15 are connected in series with one end of the other primary winding section 316B of the main transformer. The two movable contacts 543 and 546 of relay R15 may be mechanically interconnected, as shown. Movable relay contact 543 is engageable with a fixed contact 545 connected to coil 316A; movable relay contact 546 is engageable with a fixed contact 548 connected to coil 316B. An LED or other indicator 542 may be connected in parallel with coil RL15.

As long as the operating coil RL15 of relay R15 remains de-energized, the movable contacts 543 and 544 of relay R15 are latched in the positions shown in FIG. 10. In this circumstance the safety circuit 500 of FIG. 10 has no effect on the operation of voltage compensation system 300, FIG. 8. However, if there is a major failure or fault in the operation of the voltage compensation system 300 (FIG. 8), the relay coil RL14 is energized and actuates relay R14 to bring its movable contacts 531 and 534 into engagement with the fixed contacts 533 and 535, respectively. If this happens, alarm 537 is actuated and the first operating coil RL15 of relay R15 is energized to short-circuit the operating circuits for the primary winding sections 316A and 316B of the transformer 312 in the voltage compensation circuit by actuation of contacts 543 and 546. In this situation the voltage compensation circuit 300 of FIG. 8, except for the secondary winding 314 of transformer 312, is bypassed. The compensation system 300 (FIG. 8) then has no appreciable effect on the input to any utilization system connected to its output terminals L3 and L4. Operation of the voltage compensation circuit 300, with safety circuit 500 (FIG. 10), can be restored by closing switch 541 to de-energize the outer relay coil RLS 14 and allow the movable contacts 531 and 534 of relay R14 to return to their original positions as shown in FIG. 10. Of course, this is only effective if the fault affecting compensation system 300 (FIG. 8) has been corrected and coil RL14 is de-energized. If it has not been corrected, and coil RL14 is energized, the compensation system 300 is once more effectively bypassed as described above.

In any embodiment of the invention the voltage compensation system functions to modify the $V_{IN}$ input as little as necessary to maintain the output $V_{OUT}$ within the normal range for the utilization device or system to which $V_{OUT}$ is applied. The $V_{IN}$ input is not changed in frequency in the $V_{OUT}$ output; only the $V_{OUT}$ voltage level changes. The circuit components employed can be inexpensive and time-tested; no specially high-speed components are needed. Indeed, electromechanical relays are much preferred. In normal operation the voltage compensation system does not affect the utilization system to which it is connected, apart from a minor voltage drop across the secondary winding of a main transformer, and that drop is so low as to be negligible.

In all embodiments the output $V_{OUT}$ is maintained in a given normal range, without appreciable change in frequency or other parameters, despite substantial variations in the input voltage $V_{IN}$, whether above or below the normal range. Only the primary winding is switched, minimizing switching current levels and minimizing demands on the electromagnetic coupling in the main transformer. The devices of the invention are relatively small, simple, durable and inexpensive. Voltage variations of substantial duration are readily accommodated. Manual actuation of the main transformer to meet an expected sustained over- or undervoltage condition can be simple and expedient, using the connectors described in connection with FIGS. 7A through 7E or any equivalent switching arrangement.

I claim:

1. A voltage compensation system for connecting an A.C. line to utilization system having a predetermined normal voltage input range, the voltage compensation system comprising:

a transformer unit including a first transformer winding having opposite ends, at least two second transformer windings, each having opposite ends, a transformer core electromagnetically coupling the first and second transformer windings, a first input terminal adapted to be connected to an A.C. line and connected to one end of the first transformer winding, a second input terminal adapted to be connected to the A.C. line, a first output terminal connected to the other end of the first transformer winding, a second output terminal, and a transformer unit connector having a plurality of connection terminals, one connection terminal connected to each of the opposite ends of each of the transformer windings and one connection terminal connected to the second input terminal; and a plurality of second connectors, each specific to a given input voltage range and each mating with the transformer unit connector, and each having a number of control terminals, equal to the number of connection terminals, each control terminal connectable to one connection terminals, each connector constituting switching means for changing the connections of the second transformer windings to different connections from the other second connectors.

2. A voltage compensation system according to claim 1 in which the second input terminal and the second output terminal are interconnected.

3. A voltage compensation system according to claim 1, in which the second transformer winding of the transformer unit includes two winding segments having opposite ends, in which one connection terminal of the transformer unit connector is connected to each of the opposite ends of the first transformer winding, and in which one connection terminal of the transformer unit connector is connected to each of the opposite ends of each segment of the second transformer winding.

4. A voltage compensation system according to claim 3 in which the switching means includes at least three electromechanical relays having their contacts connected to the input terminals, to at least one output terminal, and to the opposite ends of the two segments of the second transformer winding.

5. A voltage compensation system according to claim 1 and further comprising a bypass circuit connected in parallel with the first transformer winding.

6. A voltage compensation system according to claim 1 and further comprising a safety circuit, connected to the first and second transformer windings, for disconnecting the second transformer winding.

7. A transformer unit for a voltage compensation system for connecting an A.C. power line to a utilization system having a predetermined normal voltage input range, the A.C. line being subject to voltage variations above or below the normal range for the utilization system, the transformer unit comprising:

at least two transformer windings, each having opposite ends;

a transformer core electromagnetically coupling the transformer windings to each other; and a connector having a plurality of connection terminals, each accessible externally of the transformer unit, the connection terminals being connected to the opposite ends of each of the transformer windings.

8. A transformer unit for a voltage compensation system for connecting an A.C. power line to a utilization system having a predetermined normal voltage input range, the A.C. line being subject to voltage variations above or below the normal range for the utilization system, the transformer unit comprising:

a main transformer including a first winding having opposite ends, a second winding including first and second winding segments each having opposite ends, and a core electromagnetically coupling the first winding to each winding segment of the second winding;

first and second input terminals each adapted to be connected to an A.C. line;

first and second output terminals each adapted to be connected to a utilization system; and said transformer unit connector having a plurality of externally accessible connector terminals, one connector terminal being connected to each of the opposite ends of each of the transformer windings and winding segments.

9. A transformer unit for a voltage compensation device for connecting an A.C. line to a utilization device, the A.C. line being subject to voltage variations outside of a predetermined line voltage range for the utilization device, the transformer unit comprising:

a first transformer winding having opposite ends:

a second transformer winding, including first and second separate transformer winding segments each having opposite ends;

a transformer core electromagnetically coupling each of the transformer winding segments of the second transformer winding to the first transformer winding;

a first input terminal adapted to be connected to the A.C. line and connected to one end of the first transformer winding;

a second input terminal adapted to be connected to the A.C. line;

a first output terminal connected to the other end of the first transformer winding;

a second output terminal connected to the second input terminal; and a connector having a plurality of connector terminals connected as follows:

two connector terminals each connected to a different one of the input terminals;

two connector terminals each connected to one of the opposite ends of the first transformer winding segment of the second transformer winding;

two connector terminals each connected to one of the opposite ends of the second transformer winding segment of the second transformer winding;

and one connector terminal connected to the first output terminal.

10. A voltage compensation system for connecting an A.C. line to a utilization system having a predetermined normal voltage input range, the voltage compensation system comprising:

a transformer unit including a first transformer winding having opposite ends, at least one second transformer winding having opposite ends, a transformer core electromagnetically coupling the first and the second transformer windings, a first input terminal adapted to be connected to an A.C. line and connected to one end of the first transformer winding, a second input terminal adapted to be connected to the A.C. line, a first output terminal connected to the other end of the first transformer winding, a second output terminal, and a transformer unit connector having a plurality of connection terminals, one connection terminal connected to each of the opposite ends of each of the transformer windings and one connection terminal connected to the second input terminal; and a second connector mating with the transformer unit connector, having a number of control terminals, equal to the number of connection terminals, each control terminal connectable to one connection terminal, the second connector constituting switching means for changing the connections of the second transformer winding.

* * * * *